United States Patent [19]

Krzysztofiak et al.

[11] 3,999,754

[45] Dec. 28, 1976

[54] TABLE TENNIS TRAINER

[76] Inventors: Richard A. Krzysztofiak, 4153 W. Nelson, Chicago, Ill. 60641; George Kalucik, 3149 N. Springfield Ave., Chicago, Ill. 60618

[22] Filed: Feb. 21, 1975

[21] Appl. No.: 551,858

[52] U.S. Cl. ..... 273/30

[51] Int. Cl.[2] ..... A63B 39/00

[58] Field of Search ..... 273/26 R, 29 A, 30, 273/129; 124/11 R, 45, 51 R, 51 A, 47, 49, 50, 13 A

[56] References Cited

UNITED STATES PATENTS

| | | | |
|---|---|---|---|
| 2,087,575 | 7/1937 | Littell et al. | 124/51 R |
| 3,037,776 | 6/1962 | Younce | 124/51 A |
| 3,089,476 | 5/1963 | Wolverton | 124/51 A X |
| 3,272,194 | 9/1966 | Egbert | 124/51 R |
| 3,640,263 | 2/1972 | Rhodes | 124/11 R |
| 3,761,085 | 9/1973 | Cook | 273/30 |
| 3,777,732 | 12/1973 | Holloway et al. | 124/51 R |
| 3,855,988 | 12/1974 | Sweeton | 124/11 R |

*Primary Examiner*—Anton A. Oechsle
*Assistant Examiner*—T. Brown
*Attorney, Agent, or Firm*—Dominik, Knechtel, Godula & Demeur

[57] ABSTRACT

A table tennis trainer having a net trap erected for positioning at one end of a tennis table and associated therewith a ball collecting and return assembly having a ball collecting tube with negative pressure gradients to move the ball to a supply box where balls are delivered by gravity into a ball feed mechanism which selectively delivers balls into a delivery tube having positive pressure gradients to propel said ball onto the table tennis surface towards a practicing player. A valve is provided to control the positive pressure gradients, to vary the propelled force to the table tennis balls, and an oscillating mechanism is provided to swing the delivery tube from side to side at a selected speed controlled remotely by the player.

9 Claims, 10 Drawing Figures

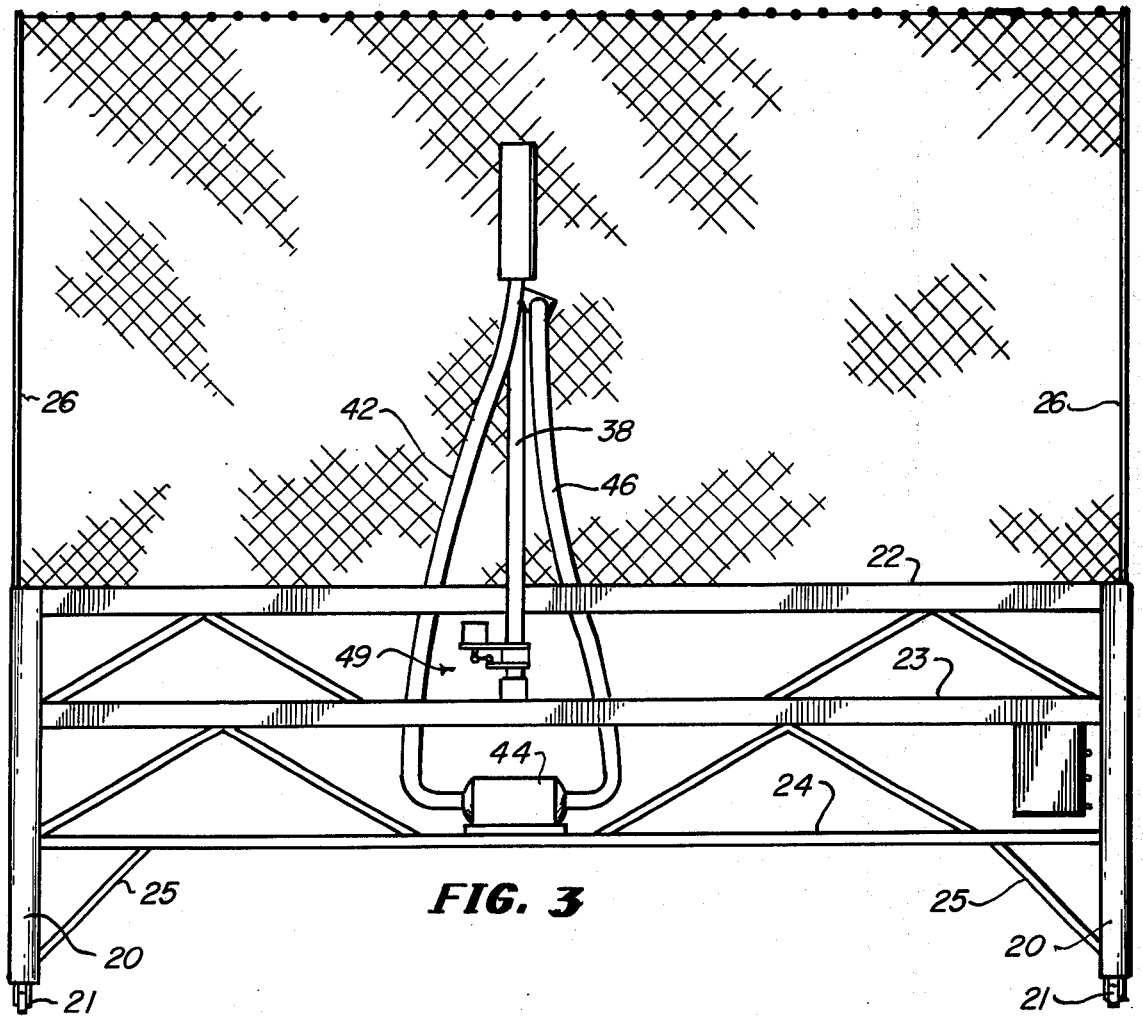
FIG. 3
FIG. 4
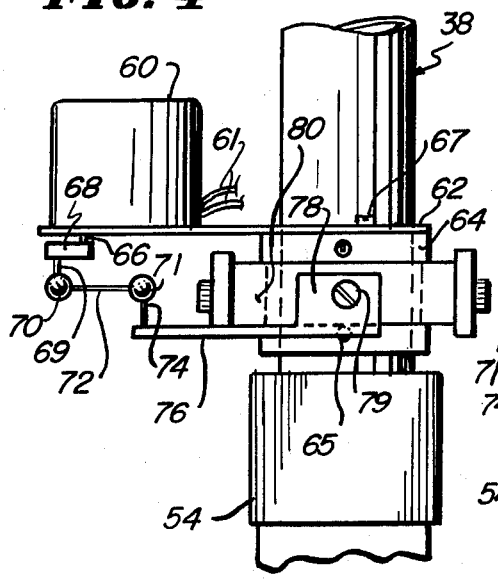
FIG. 5
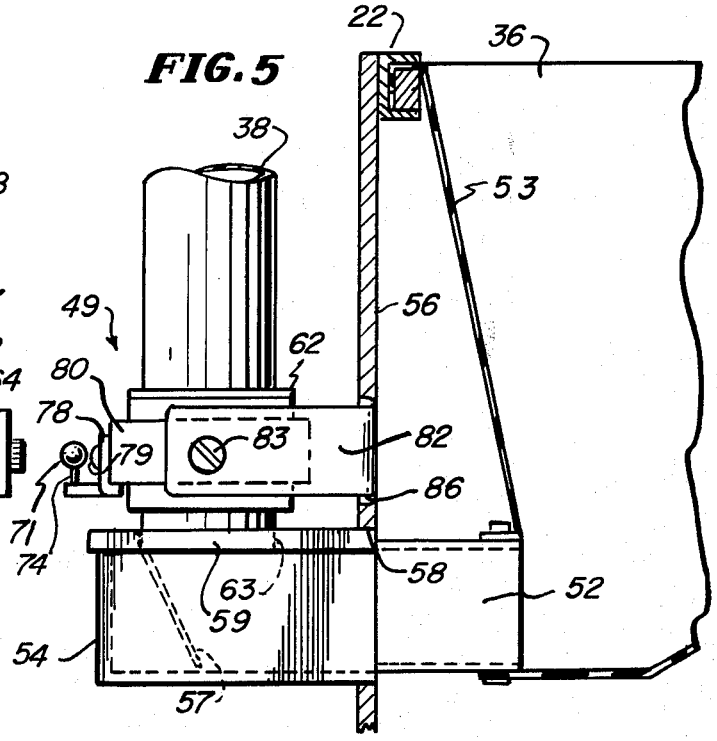

FIG. 6
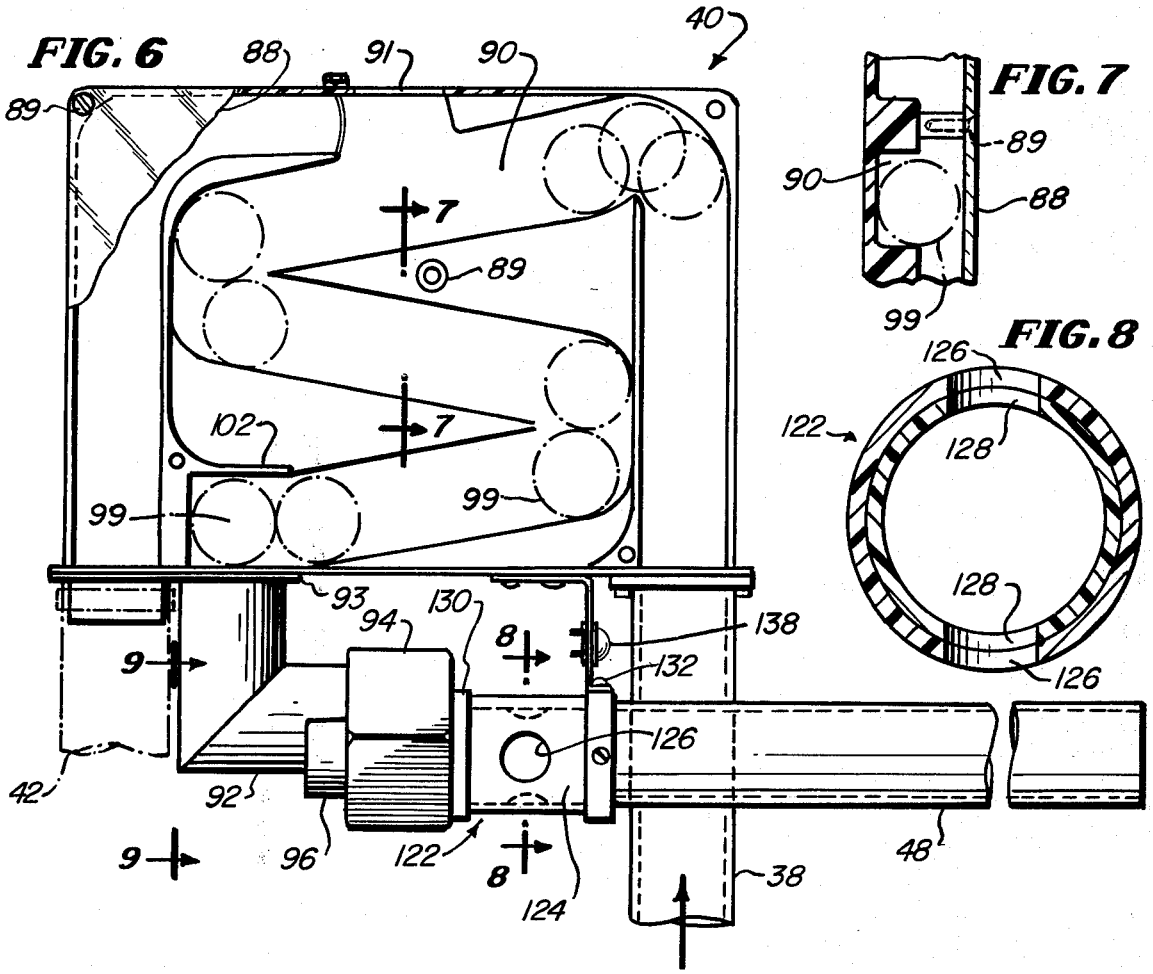
FIG. 7
FIG. 8
FIG. 9
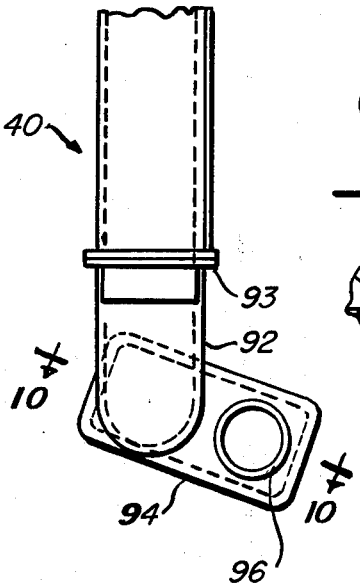
FIG. 10
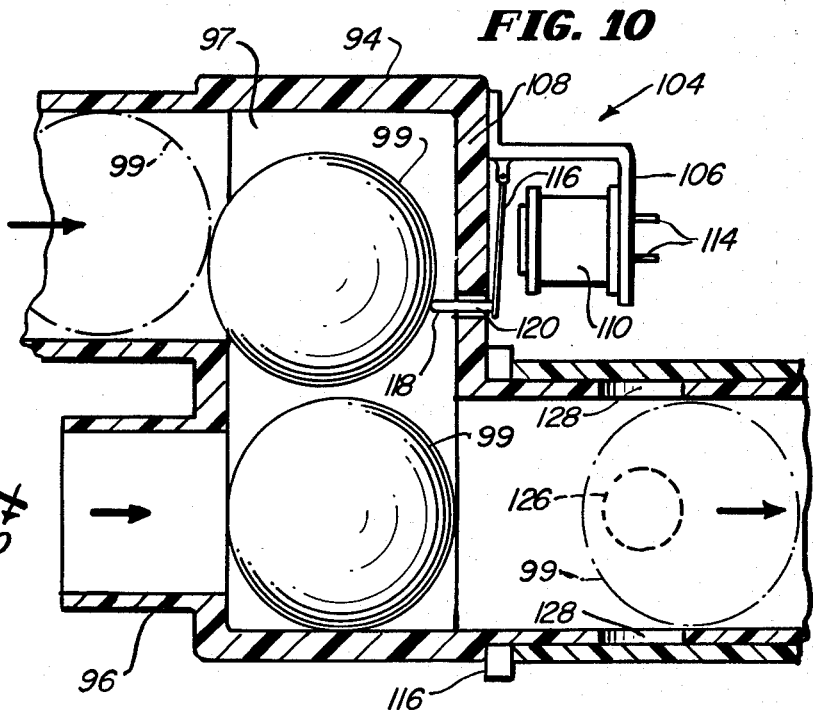

TABLE TENNIS TRAINER

This invention relates to a trainer for table tennis, particularly a trainer which quickly and reliably returns table tennis balls to a player at selected speeds and table location.

There have been various efforts made in the art to provide table tennis ball return means so that a single player can practice the game. Some of these efforts have included using pressure gradients to facilitate the collection and return of table tennis balls. For example, U.S. Pat. No. 2,793,636 shows a ball throwing machine using a rotating electric fan which creates a negative pressure gradient to attract the ball to the blades which are modified to physically strike and return the balls to the player. U.S. Pat. No. 2,508,461 uses an electrical compressor pump to propel balls back to the player under positive pressure gradients. Each of these patents uses a predetermined pressure gradient to induce movement of the ball, and each of these patents teach returning the ball in a basically uniform way.

It is desirable to use different pressure gradients in different ways to facilitate and improve the return of table tennis balls with a practicing player. It is likewise desirable to provide controls operated by the player to vary the character of the movement of the returned ball. Likewise, it is desirable to provide such improved means in a form which is readily assembled and adapted for use with existing table tennis structures which provide dependable service without undue cost complications.

It is accordingly an object of the present invention to provide an improved tennis trainer which utilizes both positive and negative pressure gradients to propel a ball towards the player and to collect a ball returned by the player to simulate actual game conditions.

Still another object is to provide an improved tennis trainer which can be quickly positioned next to an ordinary tennis table so that balls returned by a player are reliably trapped and conveyed under negative pressure gradients to a supply box where a number of balls are stored and periodically delivered through selectively operated feed means to a delivery tube which propels the ball under positive pressure gradients.

Yet still another object of the present invention is an improved tennis trainer of the type described which is provided with control means to selectively vary the force of the propelled table tennis ball returned to the player, as well as to vary the location of the returned ball by swinging or selectively positioning a return delivery tube.

Such objects are attained together with still other objects which will occur to practitioners from time to time upon considering the invention shown in the following disclosure, including drawings wherein:

FIG. 3 is a rear elevational view of the trainer assembly in combination with a mobile base and entrapment net, on a still further enlarged scale;

FIG. 4 is a portional rear elevational view of a swivel mechanism for oscillating a ball return means;

FIG. 5 is a portional side elevational view of the swivel mechanism shown in the view of FIG. 4;

FIG. 6 is a side elevational view of a table tennis ball supply box and feed means combination;

FIG. 7 is a portional sectional view taken along line 7—7 of FIG. 6;

FIG. 8 is a sectional view, on an enlarged scale, taken along line 8—8 of FIG. 6;

FIG. 9 is a rear elevational view of the feed means taken along line 9—9 of FIG. 6; and FIG. 10 is a sectional view taken on an enlarged scale along line 10—10 in the view of FIG. 9.

Figure 1:
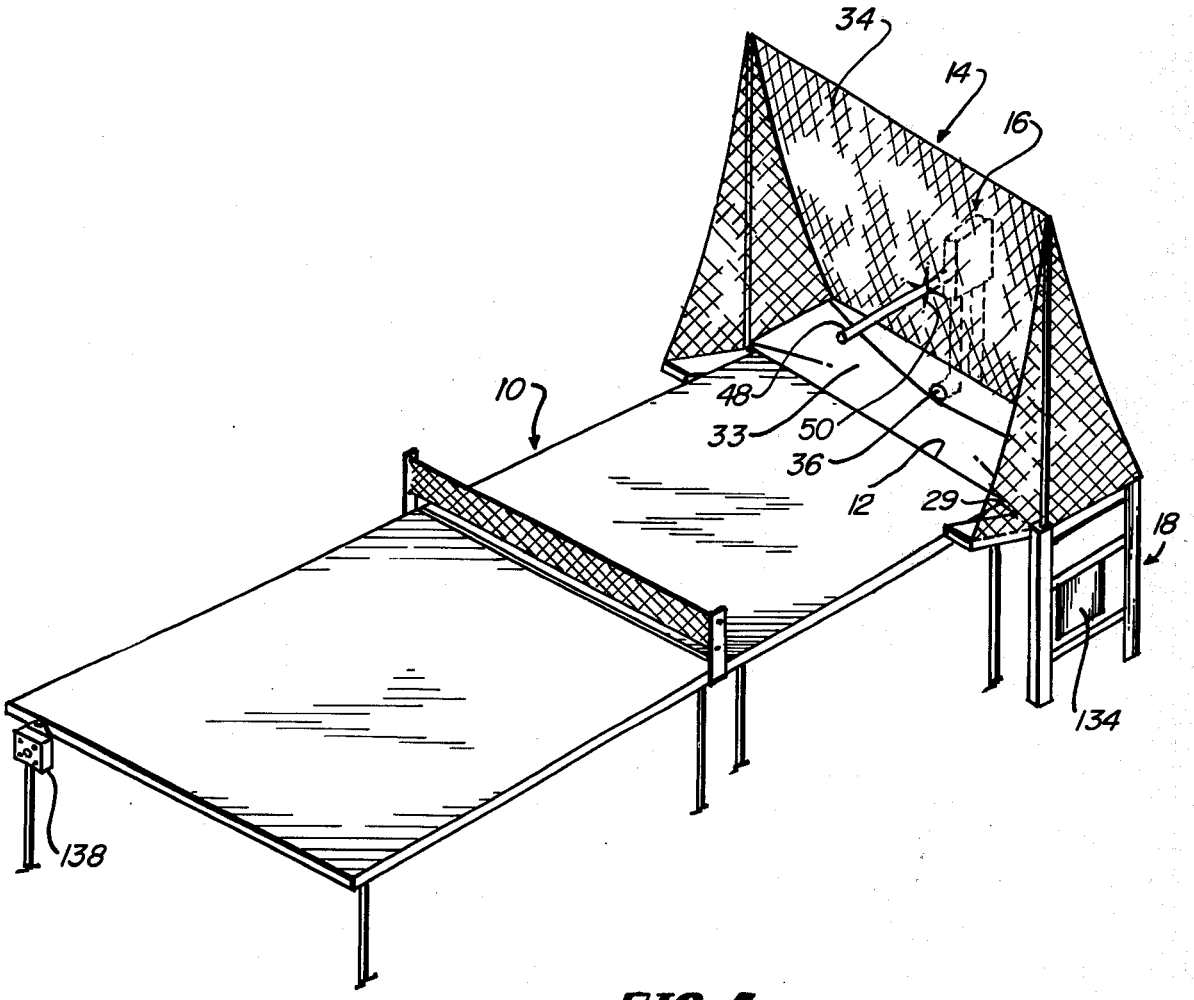
FIG. 1 is a perspective view of the table tennis trainer shown positioned at the end of a tennis table.

The view of FIG. 1 shows a conventional tennis table 10 with the tennis trainer positioned at one end 12 thereof. The tennis trainer includes a ball trap shown generally as net 14. Associated with the net trap is a return assembly shown generally as 16, and the trap and return assembly are further shown mounted on a mobile base generally shown as 18.

Figure 2:
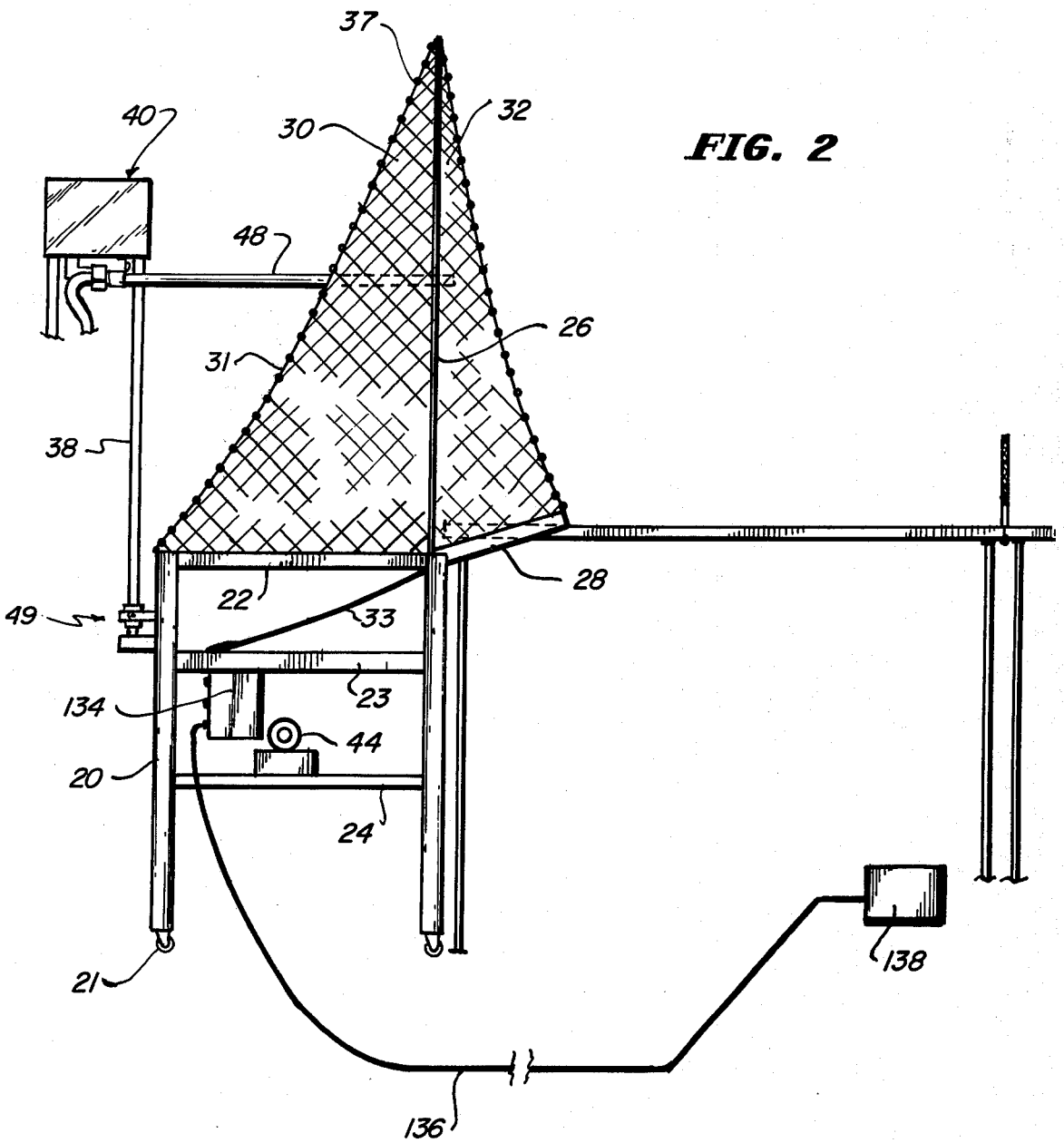
FIG. 2 is a portional side elevational view, on an enlarged scale, of the table tennis trainer positioned at the end of a tennis table as shown in FIG. 1.

Further references to FIGS. 2 and 3 illustrate the mobile base as having a plurality of legs 20, each of which is fitted with casters 21. The mobile base has an upper rectangular frame 22 formed from four sides and comprising an open top to accommodate portions of the net trap. An intermediate rectangular frame member 23 is provided as well as a lower rectangular frame member 24. A plurality of braces 25 are shown in association with the frame, shelves and legs.

The net trap can be folded when inoperative and supported on the base. The net trap is erected to operative position readily by raising collapsible poles 26 which may be fitted in mounting bores in the rectangular frame 22 or be pivoted thereto or be otherwise mounted. The net trap is used in association with side guide arms 28 which are spaced apart a sufficient distance to flank the opposite sides of the playing surface of the table tennis at one end thereof, as shown, such arms being joined at pivots 29 to the frame member 22. The guide arms can be folded back onto the base when the assembly is inoperative.

The triangular side panels 30 of the net trap are, in part, mounted to said side guide arms 28. Such triangular side panels are seen as having a curved back side 31 and a curved front side 32 to represent the sides of the triangular configuration. Such sides may be defined by attaching string to the unitary net fabric and securing such string to the top of the poles 26. A bottom support 33 of the net trap is downwardly curved to provide a low point for the trapped table tennis balls. Such bottom support 33 is accommodated in the mobile base between the intermediate frame 23 and the upper frame 22. The bottom support may be a sheet of plastic, fabric or the like. The net structure is completed by a substantially rectangular back panel 34. The bottom edge of the back panel may be fastened to the back part of the upper frame member 22, and portions of the triangular side panels may be likewise fastened to the side parts of the rectangular frame part.

The bottom suport 33 is seen as having a mouth 36 at a low point thereof to collect struck table tennis balls into a ball collecting tube 38. The mouth 36 joins an angular branch of the ball delivery tube which is positioned below the playing surface of the tennis table. The angular branch joins and is normal to a vertical branch, and this vertical branch communicates with a supply box 40 for the table tennis balls.

A negative pressure conduit 42 connects the supply box 40 to the negative pressure side to an air moving motor 44. The positive pressure side of the motor, such as an electric turbine, is connected to a positive pressure conduit 46 which establishes positive pressure in an ejector tube or barrel 48. The positive pressure propels balls deposited in the ejector tube towards the practicing player, such ejector tube being positioned above the table surface and at a right angle or normal to the vertical branch of the delivery tube.

A swing mechanism shown generally as 49 is shown associated with the vertical branch of the delivery tube. This swing mechanism rotationally oscillates the vertical branch of the delivery tube and the ball storage box to which the ejector tube 48 is mounted so that such ejector tube swings towards the opposite sides of the table tennis surace. The ejector tube extends through an opening 50 in the back panel 34 of the net trap.

Details of the swing mechanism may now be seen in the views of FIGS. 4 and 5. The angular branch of the delivery tube is shown as including a ball inlet tube 52 which receives the balls from the mouth 36 of the delivery tube with the help of guide wall 53. The angular portion of the delivery arm further includes a ball transfer box 54 which communicates with the ball inlet tube 52. A mounting plate 56 is shown affixed to a part of the rectangular frame member 52, and such mounting plate desirably extends to the upper frame member 22. The mounting plate is shown with a box opening 58 which securely receives and holds the ball transfer box 54. A cover 59 on the box has an oversize opening 63 for the bottom of tube 38. A guide fringer 57 directs the balls into the vertical branch of the delivery tube.

The swing mechanism is actuated by an electric motor 60 which is powered by usual voltage sources through cord leads 61. A motor support bracket 62 holds the motor at one end and the other end has an opening which allows motor support bracket 62 to be affixed to a mounting collar 64 by fasteners, one of which is shown at 67. The collar 64 is positioned around the vertical portion of the delivery tube, and is secured to the vertical tube portion by set screws 65. The motor shaft 66 can be rotated at varying rotational speeds by providing usual controls, and such shaft rotates a cam element 68 which is pivotally mounted to an upper cam rod 69. The other end of the upper cam rod is pivotally mounted to a swivel sphere assembly 70 which is joined to another swivel sphere assembly 71 by a connecting cam rod 72 with fixed connections. A lower cam rod 74 has one end pivoted to the sphere 71 and the opposite end fixed to bracket plate 76.

The bracket plate 76 has upturned prebent portions 78, one on each side, each being fastened by screws 79 to a slip fit ring 80 mounted on collar 64. A U-shaped mount 82 has its opposite arms secured by pivot fasteners 83 to ring 80. The motor 60, bracket 62, collar 64 and tube 38 oscillates as a unit. The U-shaped mount is fixed to the mounting plate 56 at mounting aperture 86. The bottom of the vertical branch of the delivery tube rotationally oscillates in opening 63 in the top cover 59 of the ball transfer box 54. The delivery tube may be selectively tilted towards and away from the table to select an angle of ball trajectory, and such tilt is effected at pivot fasteners 83. Tilting the tube towards the table will displace the cover in the opposite direction. Such displaced cover remains sealingly mounted on the box so pressure gradients within the box are not upset.

Under urgings of negative pressure, the table tennis ball is moved through the delivery tube into the supply box 40. Such box preferably is provided with a transparent plastic cover 88 which is removably secured to portions of the box by screw fasteners 89. The delivery tube 38 deposits balls into a downwardly reversing path 90 within the supply box. An opening 91 at the top of the box communicates with the reversing path. The balls move down the reversing path under gravity, and are sequentially deposited into angular ball drop tube 92. The ball drop tube 92 is secured to the bottom of the supply box 40 by mounting plate 93 which also secures the supply box part of the negative conduit to lower parts of the negative conduit 42.

The angular tube transfers the balls to a feed mechanism which includes a ball release container 94. Such ball container is angled downwardly relative to the table tennis surface so that balls may be periodically released under urgings of gravity from the upper part of the container to the lower part thereof. The back of the ball release container is provided with a positive pressure inlet stub 96 to which is mounted the positive pressure conduit 46. A chamber 97 within the ball release container has an upper volume in which a ball is first introduced and held until released into the lower volume of the chamber. The opening permits manual feed of balls into the storage box and, additionally, operates to control pressure levels in an operating circuit by providing an entry for ambient air.

When a ball is expelled under positive pressure, a back pressure is exerted on the last ball 99 in path 90, through intermediate balls. Ball 99 is urged against immediately adjacent shield 102, which extends to opposite side walls of the supply box, such shield blocking the positive air flow. It is seen, therefore, that following ball 99 operates in the way of shut-off valve. The smaller opening in tube 96 accelerates air movement by venturi effect, and this faster movement creates back pressure against the upper balls. New charges of ambient air enter the operating circuit through opening 91 in the supply box.

The release means are shown generally as 104 and includes a reverse angle bracket 106 which is mounted at one end to the wall 108 of the ball release container. An electromagnet 110 is shown with leads 114, and the energized electromagnet attracts armature 116 which is normally biased towards wall 101 by spring means, not shown. A stop pin 118 is fixed to the bottom of the armature, and such pin 118 passes through an opening 120 in the wall 108. The stop pin 118 holds a ball in the upper volume of the chamber which is shown as accommodating two balls. When the armature is attracted to the electromagnet, the stop pin moves out of stop position and allows the ball to drop from the upper part of the chamber into the lower part. The ball dropped into the lower part falls into the positive pressure path of the ejector tube and is propelled from said tube under urgings of the positive pressure towards the practicing player.

The force with which the ball is propelled can be controlled by various means such as providing a variable speed electric motor with said controls, or by providing means such as a pressure valve assembly 122 positioned between the ball release container and the ejector tube. The illustrated pressure valve assembly has an annular sleeve 124 mounted to the cylindrical delivery tube, and this sleeve is provided with a plurality of sleeve ports 126. The ejector or barrel tube also has a plurality of barrel ports 128 which can be selectively registered, upon rotation of the annular sleeve, with the sleeve port. The larger the registered areas of the ports, the more atmospheric air will communicate with the pressurized air to reduce the force of propulsion. A spacer ring 130 is shown between the annular sleeve 124 and the wall 108 of the ball release container. A locking ring and bracket are shown collectively as 132 to position the annular sleeve of the pressure valve assembly.

It is preferable to provide electrical control means to operate the swing mechanism and the working of the vacuum motor when variable motor means are provided. The mobile base can be provided with the electrical control circuit, shown as mounted at 134 to the underside of intermediate frame member 23. Such box is remotely connected by conductors 136 to a control box 138 which may be positioned conveniently on or near the table tennis for ready access by the practicing player. Such electrical circuit and control can provide preset positioning of the ejector tube 40, or the swinging of such tube can be varied by controlling the rotational speed of the shaft 66 of the electric motor 60 in the swing mechanism. All of these controls and circuits can be conventionally provided and do not, as such, provide an essential portion of the present invention. It will be also appreciated that high frequency sound emission controls can be provided to operate the swing mechanism and to vary the vacuum motor, or even to remotely operate the pressure valve assembly.

Such remote control means, of course, also control the ball release means selectively. The rate of ball delivery can be selected by the rate at which the ball release means is actuated. It is preferred to provide the ejector tube with a readily detectable signal light, such as 138 in association with the delivery tube, see FIG. 6. Such a light is activated at the same time the ball release mechanism is actuated to provide the practicing player with notice that a ball will be immediately propelled towards such player. The light is connected to the electrical circuit control 134 to provide desired actuation.

The air control motor has been shown mounted to the brace frame of the mobile unit in spaced relationship to the supply box. Alternatively, such an air control member may be mounted in an enlarged supply box, or adjacent thereto, to provide a unitary assembly.

The claims of the invention are now presented and the terms of such claims may be further understood by reference to the language of the preceding specification and by considering the views of the drawings.

What is claimed is:

1. A table tennis return assembly including a base member, an erectable ball trap net on said base member, said net dimensioned to extend at least to the opposite sides of one end of a tennis table support surface, a bottom support associated with said net and base member, a low point on said bottom support below the table support surface;

a ball collecting tube, a mouth of said ball collecting tube positioned at said low point of the bottom support, a supply box mounted to said base member, said box receiving table tennis balls from said ball collecting tube, said supply box having a downward ball path and an air opening, an ejector tube for propelling table tennis balls, said ejector tube being joined to said supply box, an electrically powered vacuum motor to establish opposite pressure gradients so that a negative pressure is established in said ball collecting tube, and a positive pressure is established in said ejector tube, said negative pressure conveying the balls directly from the mouth of the tube to the supply box and said positive pressure propelling the balls onto the table support surface, and a transfer chamber with an enlarged volume relative to a table tennis ball, said chamber being between the supply box and the ejector tube, to receive a ball in an upper volume portion and to selectively release the table tennis ball to drop into a lower volume portion and into the positive pressure path of said ejector tube.

2. A table tennis return assembly which includes the features of claim 1 above, wherein said ejector tube is mounted to said supply box so that said ejector tube is positioned above the table tennis surface, and wherein said ball collecting tube is an angular member having a vertical branch which is substantially normal to the ejector tube, and a collecting branch being substantially normal to said vertical branch and positioned below the table tennis surface.

3. A table tennis return assembly which includes the features of claim 2 above wherein said transfer chamber includes a selectively operating stop means which holds a ball at a raised position in an upper volume above the positive pressure paths of the ejector tube, said stop means being selectively withdrawn to drop said ball into a lower volume and into the positive pressure path communicating with said ejector tube.

4. A table tennis return assembly which includes the features of claim 3 above wherein said supply box has a downwardly reversing path for said table tennis balls delivered to the supply box from said delivery tube, said negative pressure conduit communicating with said reversing path to urge the table tennis balls to enter said path, and further including a transfer tube connecting the bottom of said reversing path to said feed means.

5. A table tennis return assembly which includes the features of claim 4 above which further includes a swing mechanism connected to said delivery tube, said swing mechanism having oscillating movement so that said delivery tube swings back and forth in a plane over the table tennis surface.

6. A table tennis return assembly and combination as in claim 5 which further includes remote control means operated by the table tennis player to selectively impart oscillating movement to said delivery tube.

7. A table tennis return assembly which includes the features of claim 4 above wherein said delivery tube includes a valve member to vary communication with atmospheric air to selectively change positive pressure gradients in said ejector tube.

8. A table tennis return assembly and combination as in claim 1 wherein said base member is a mobile base on which is mounted said return assembly and said net trap.

9. A table tennis return assembly and combination as in claim 8 which further includes tilting means mounting said delivery tube to said mobile base to allow said ejector tube to be angularly positioned relative to the table tennis surface.

* * * * *